US008091844B1

(12) United States Patent
Bragg

(10) Patent No.: US 8,091,844 B1
(45) Date of Patent: Jan. 10, 2012

(54) AIR CONDITIONER SUPPORT DEVICE

(76) Inventor: Dana C. Bragg, Auburn, ME (US)

( * ) Notice: Subject to any disclaimer, the term of this patent is extended or adjusted under 35 U.S.C. 154(b) by 472 days.

(21) Appl. No.: 12/324,547

(22) Filed: Nov. 26, 2008

(51) Int. Cl.
*F16M 11/00* (2006.01)

(52) U.S. Cl. ..... 248/208; 248/220.21; 248/226.11

(58) Field of Classification Search ..... 248/208, 248/220.21, 226.11, 121, 187.1, 918
See application file for complete search history.

(56) References Cited

U.S. PATENT DOCUMENTS

| | | | | |
|---|---|---|---|---|
| 2,717,139 | A | 9/1955 | Jewell | |
| 2,758,456 | A * | 8/1956 | Wheeler | 62/262 |
| 2,935,284 | A | 5/1960 | Reeves | |
| 3,273,843 | A | 9/1966 | Bell, Jr. et al. | |
| D288,570 | S | 3/1987 | Fonceca | |
| 5,112,015 | A | 5/1992 | Williams | |
| 5,636,816 | A | 6/1997 | Burton et al. | |
| 6,738,094 | B1 * | 5/2004 | Minami et al. | 348/373 |
| 7,066,664 | B1 * | 6/2006 | Sitoh et al. | 396/428 |
| 7,219,866 | B2 * | 5/2007 | Depay et al. | 248/229.22 |
| 7,572,073 | B2 * | 8/2009 | Kenoyer et al. | 396/428 |
| 7,703,731 | B1 * | 4/2010 | Kuo | 248/229.22 |
| D626,165 | S * | 10/2010 | Raken et al. | D16/242 |
| 2005/0230583 | A1 * | 10/2005 | Wu | 248/231.41 |

* cited by examiner

*Primary Examiner* — Terrell McKinnon
*Assistant Examiner* — Steven Marsh

(57) ABSTRACT

An air conditioner support device for supporting an air conditioner in a window unit in a building, said air conditioner support device comprising a platform having a first half and a second half slidably connected via a connecting rod; a lip disposed on the first side of the first and second half of the platform; a first adjustable pivot arm and second adjustable pivot arm for supporting the platform in the window unit; wherein the platform is for placing in the window unit over a window sill and below a window wherein the air conditioner can be placed atop the platform.

2 Claims, 6 Drawing Sheets

(ISO)

(ISO-OPEN POSITION)

(UNDERNEATH VIEW)

(IN USE)

(EXPLODED VIEW)

(SECTION THRU FIG 1)

(SECTIONAL VIEW THRU
TWO HALVES OF SUPPORT PLATFORM)

AIR CONDITIONER SUPPORT DEVICE

FIELD OF THE INVENTION

The present invention is directed to a support device for an air conditioner to be placed in a window.

BACKGROUND OF THE INVENTION

The present invention features an air conditioner support device for supporting an air conditioner in a window unit of a building. The air conditioner support device of the present invention comprises a platform having a first half and a second half slidably connected via a connecting rod. A lip is disposed on both the first and second half of the platform. A first adjustable pivot arm and second adjustable pivot arm supports the platform in the window unit. The platform is for placing in the window unit over a window sill and below a window wherein the air conditioner can be placed atop the platform.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
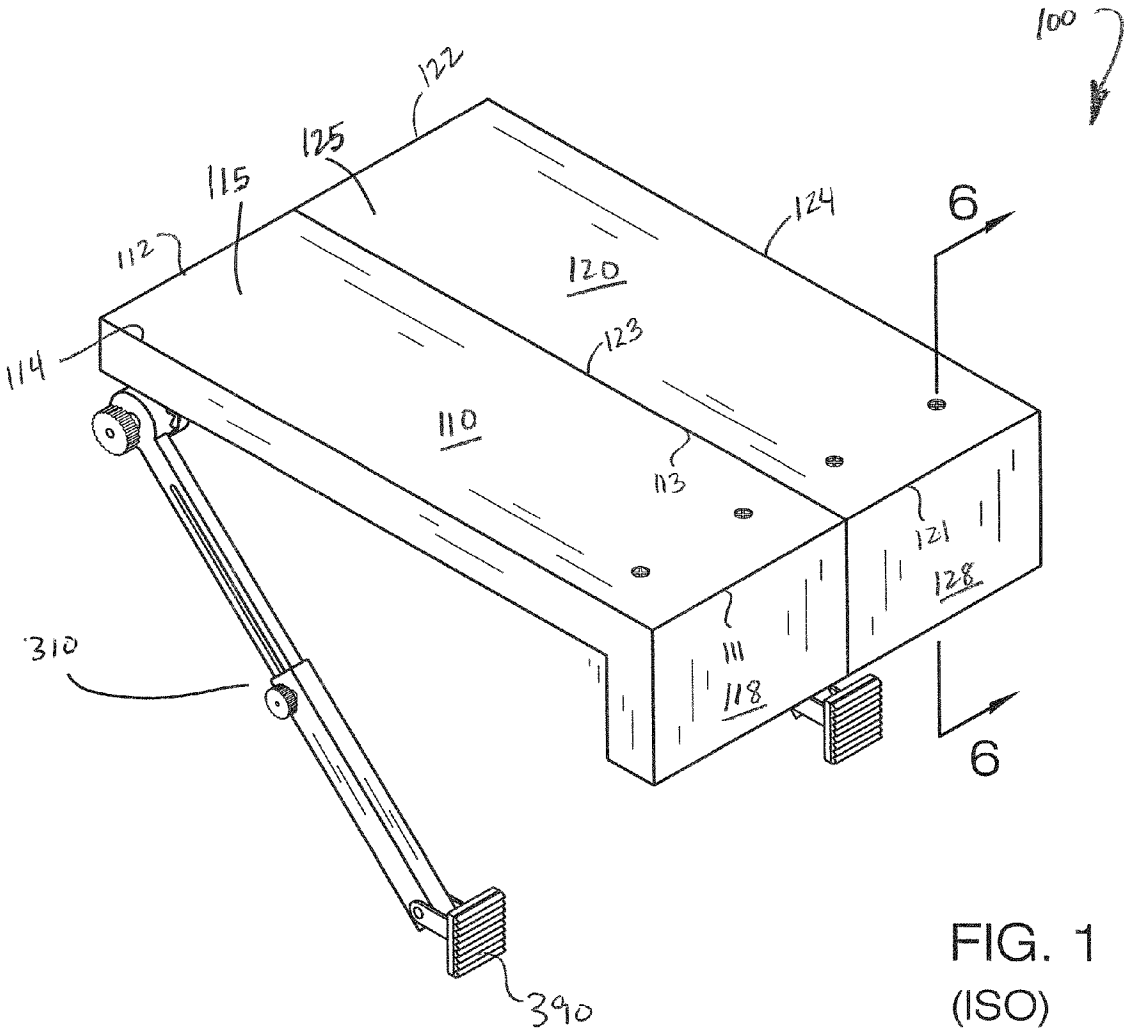
FIG. 1 is a top perspective view of the air conditioner support device of the present invention.

The following is a listing of numbers corresponding to a particular element referred to herein:

100 air conditioner support device
110 first half
111 first side of first half
112 second side of first half
113 third side of first half
114 fourth side of first half
115 top surface of first half
116 bottom surface of first half
118 first lip
120 second half
121 first side of second half
122 second side of second half
123 third side of second half
124 fourth side of second half
125 top surface of second half
126 bottom surface of second half

Figure 2:
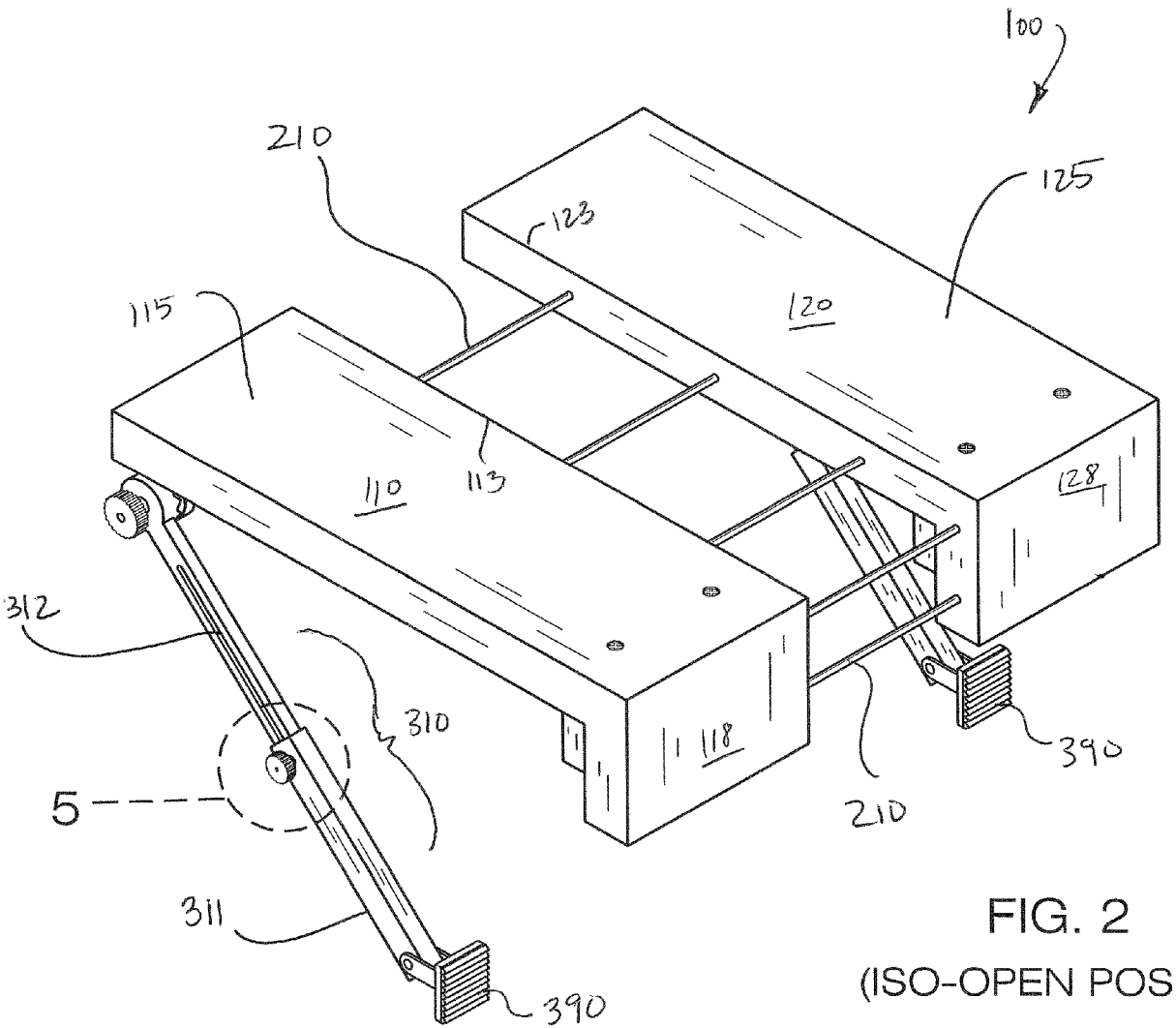
FIG. 2 is a top perspective view of the air conditioner support device of the present invention.
Figure 3:
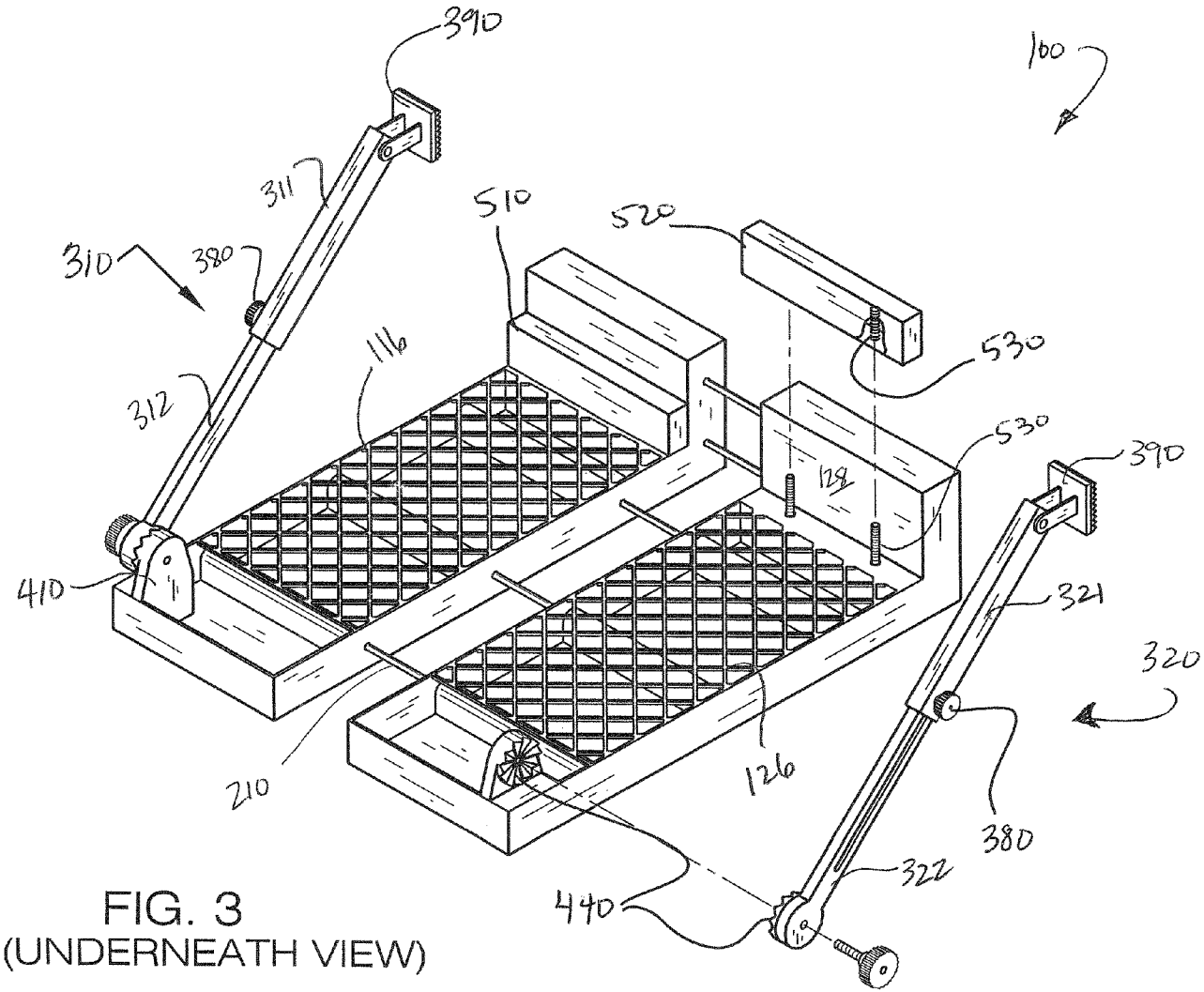
FIG. 3 is a bottom perspective view of the air conditioner support device of the present invention.
Figure 4:
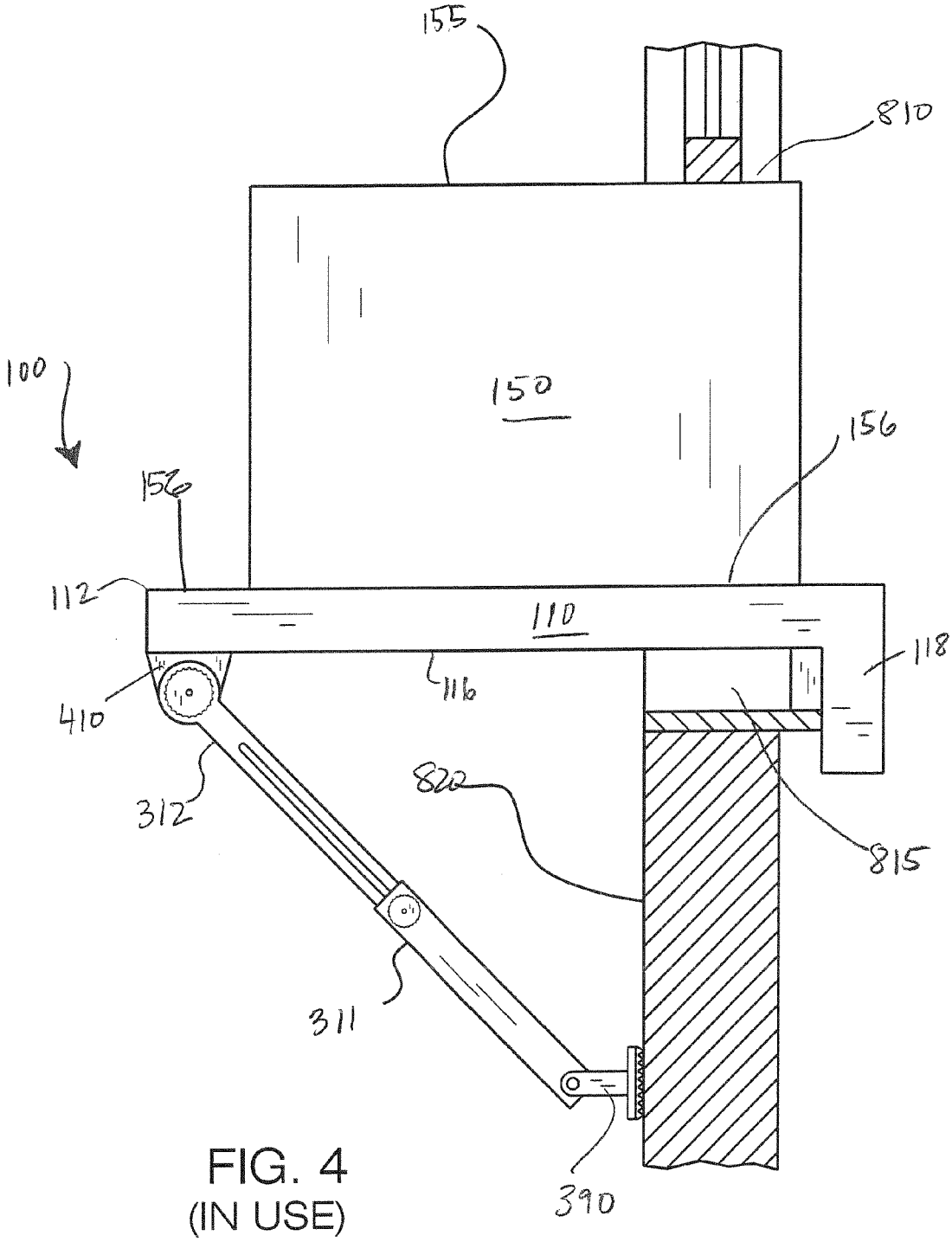
FIG. 4 is a side view of the air conditioner support device of the present invention.
Figure 5:
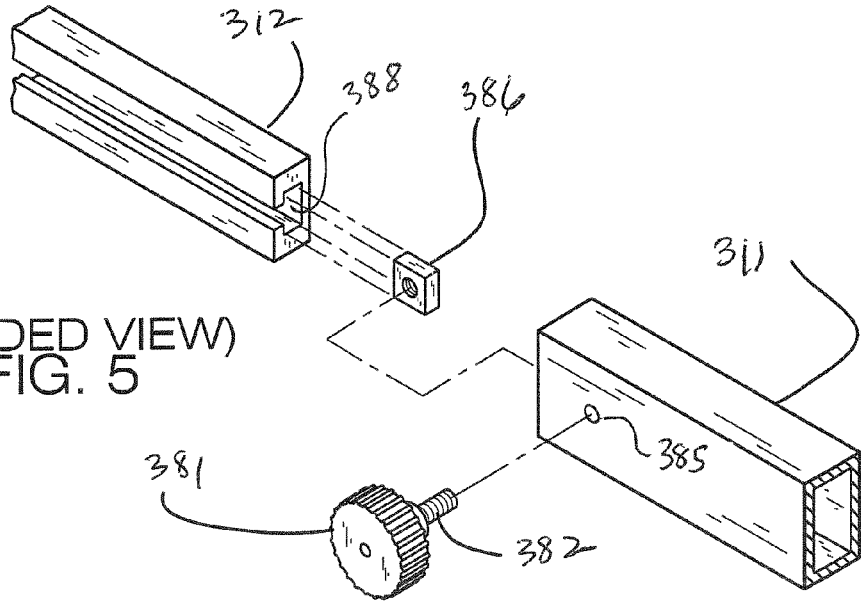
FIG. 5 is an exploded view of the air conditioner support device of the present invention.
Figure 6:
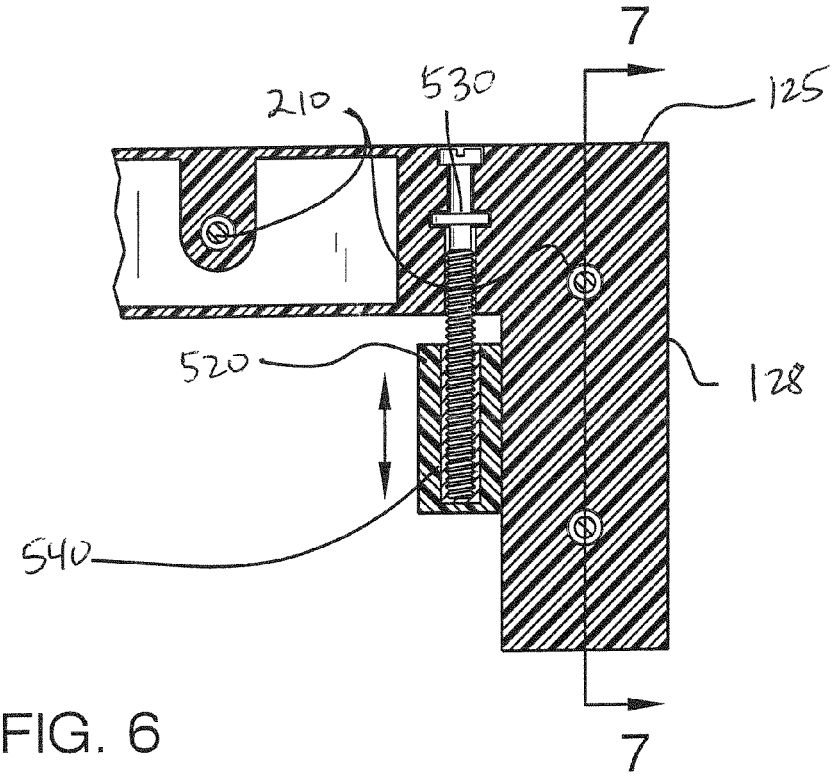
FIG. 6 is a cross sectional view of the air conditioner support device of the present invention.
Figure 7:
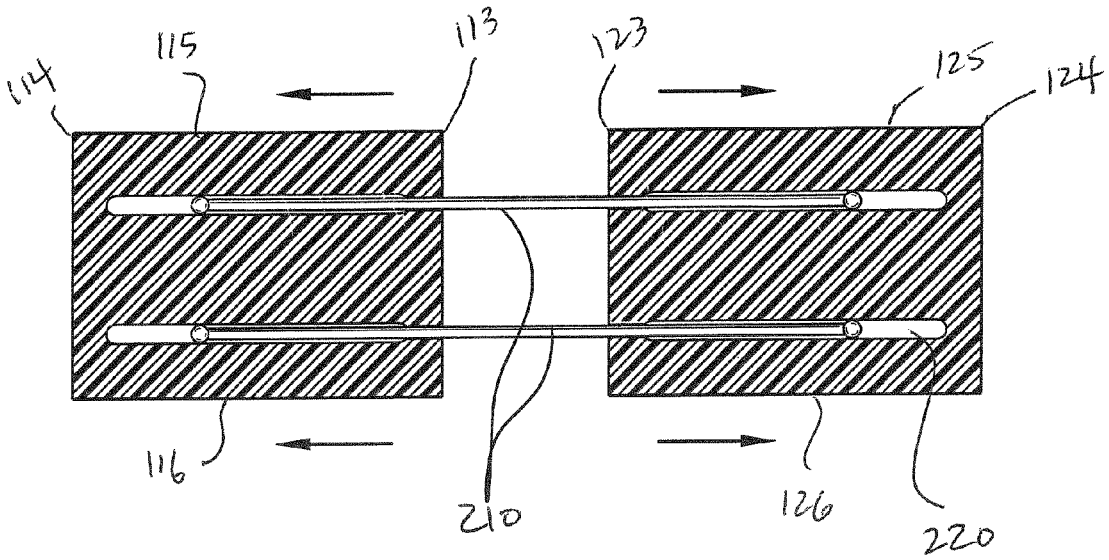
FIG. 7 is a cross sectional view of the air conditioner support device of the present invention.

128 second lip
150 air conditioner
155 top surface of air conditioner
156 bottom surface of air conditioner
210 connecting rod
220 connecting rod channels
310 first adjustable pivot arm
311 outer pole of first adjustable pivot arm
312 inner pole of first adjustable pivot arm
320 second adjustable pivot arm
321 outer pole of first adjustable pivot arm
322 inner pole of first adjustable pivot arm
331 outer pole
380 locking knob
381 knob end
382 screw end
385 screw aperture
386 threaded nut
388 nut channel
390 attachment pad
410 pivot device
440 gear system
510 first adjustment bar
520 second adjustment bar
530 bolt
540 bolt column
810 bottom of window
815 window sill
820 wall of building Referring now to FIG. 1-7, the present invention features an air conditioner device for supporting an air conditioner in a window. The air conditioner support device comprises a platform having a first half and a second half. The first half has a top surface, a bottom surface, a first side, a second side, a third side, and a fourth side. The second half has a top surface, a bottom surface, a first side, a second side, a third side, and a fourth side (see FIG. 1).

The third side of the first half and the third side of the second half are removably connected via a connecting rod. The connecting rod allows the first half and the second half to slide closer together or farther apart (see FIG. 2). In some embodiments, a plurality of connecting rods slidably connects the first half of the platform to the second half of the platform. In some embodiments, the connecting rod is disposed in a connecting rod channel inside the first half and the second half of the platform (see FIG. 7).

Disposed on the first side of the first half of the platform is a first lip that extends downwardly and generally perpendicularly from the top surface of the first half of the platform. Disposed on the first side of the second half of the platform is a second lip that extends downwardly and generally perpendicularly from the top surface of the second half of the platform.

The platform is for placing in a window unit over a window sill and below a window. In some embodiments, the first lip and second lip extend over the window sill and into the room of the building, wherein the platform extends outwardly from the window sill. An air conditioner can be placed atop the platform such that the bottom surface of the air conditioner rests on the top surface of the first half and second half of the platform and the top surface of the air conditioner rests below the window.

A first adjustable pivot arm and a second adjustable pivot arm support the first half and second half atop the window sill in the window unit. The first adjustable pivot arm has an inner pole telescopically received in an outer pole. The inner pole has a first end and a second end, and the outer pole has a first end and a second end. The first end of the inner pole is pivotally attached to the bottom surface of the first half of the platform via a pivot device.

The length of the first adjustable pivot arm as measured from the first end of the inner pole to the second end of the outer pole is adjustable by sliding the inner pole in or out of the outer pole.

The second adjustable pivot arm has an inner pole telescopically received in an outer pole. The inner pole has a first end and a second end, and the outer pole has a first end and a second end. The first end of the inner pole is pivotally attached to the bottom surface of the first half via a pivot device.

The length of the second adjustable pivot arm as measured from the first end of the inner pole to the second end of the outer pole is adjustable by sliding the inner pole in or out of the outer pole.

A locking knob disposed on the first end of the outer pole can secure the inner pole inside the outer pole to lock the length of the first adjustable pivot arm. A locking knob disposed on the first end of the outer pole can secure the inner pole inside the outer pole to lock the length of the second adjustable pivot arm. In some embodiments, the locking knob has a knob end and a screw end, wherein the screw end can be inserted into a screw aperture disposed in the outer pole of the first adjustable pivot arm or second adjustable pivot arm (see FIG. 6).

In some embodiments, a threaded nut is aligned with the screw aperture such the screw end of the locking knob screws into the screw aperture and threaded nut simultaneously. In some embodiments, a nut channel is disposed in the inner pole of the first or second adjustable pivot arm to allow the threaded nut to slide in and out of the inner pole. The threaded nut allows the locking knob to secure the inner pole inside the outer pole to lock the length of the adjustable pivot arm.

In some embodiments, the first end of the inner pole of the first adjustable pivot arm and/or second adjustable pivot arm is attached to the bottom surface of the first half and/or second half, respectively, via a pivot device. In some embodiments, the pivot device comprises a gear system (see FIG. 3).

A first attachment pad is pivotally attached to the second end of the outer pole of the first adjustable pivot arm, and a second attachment pad is pivotally attached to the second end of the outer pole of the second adjustable pivot arm. The first attachment pad and second attachment pad help to secure the first adjustable pivot arm and the second adjustable pivot arm to the wall of the building below the window unit. The first attachment pad and second attachment pad prevent the pivot arms from sliding up or down the wall.

In some embodiments, the air conditioner support device of the present invention further comprises a first adjustment bar and a second adjustment bar. The first adjustment bar is removably attached to the bottom surface of the first half near the first lip (see FIG. 3). The second adjustment bar is removably attached to the bottom surface of the second half near the first lip (see FIG. 3). The first adjustment bar can help to raise or lower the first half 110, and the second adjustment bar can help to raise or lower the second half 120.

In some embodiments, the first adjustment bar is attached to the first half via an attachment means. In some embodiments, the second adjustment bar is attached to the second half via an attachment means. For example, in some embodiments, the attachment means includes a bolt, a screw, a nail, the like, or a combination thereof. The attachment means can be inserted into an attachment means column (e.g., a bolt column) disposed in the first adjustment bar or in the second adjustment bar.

Disposed in the first adjustment bar is a threading such that the attachment means (e.g., a screw) can turn in a first direction and a second direction. For example, in some embodiments, if the screw is turned in a first direction, the first adjustment bar moves downwardly away from the first half 110, which raises the first half 110. In some embodiments, when the screw is turned in a second direction, the first adjustment bar moves upwardly toward the first half, which lowers the first half 110. In some embodiments, the first adjustment bar and/or second bar can help keep the first half and/or second half from resting on a vinyl replacement window frame.

In some embodiments, a user can slide the first half of the platform closer to or farther from the second half to accommodate the air conditioner. For example, an air conditioner may be wider than the first half and second half of the platform, so the user can widen the platform by sliding the two halves farther apart.

The air conditioner support device of the present invention may be constructed form a variety of materials. For example, in some embodiments, the air conditioner support device of the present invention may be constructed from a material comprising a metal, a wood, a plastic, a rubber, a foam, the like, or a combination thereof.

The disclosures of the following U.S. Patents are incorporated in their entirety by reference herein: U.S. Pat. No. 5,636,816; U.S. Pat. No. 2,935,284; U.S. Pat. No. 3,273,843; U.S. Pat. No. 5,112,015; U.S. Pat. No. 2,717,139.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An air conditioner support device for supporting an air conditioner in a window unit in a building, said air conditioner support device comprising:

(a) a platform having a first half and a second half, wherein the first half has a top surface, a bottom surface, a first side, a second side, a third side, and a fourth side; wherein the second half has a top surface, a bottom surface, a first side, a second side, a third side, and a fourth side; wherein the third side of the first half and the third side of the second half are slidably connected via a connecting rod; wherein the connecting rod allows the first half and the second half to slide closer together or farther apart;

(b) a first lip disposed on the first side of the first half of the platform, wherein the first lip extends downwardly and generally perpendicularly from the top surface of the first half of the platform;

(c) a second lip disposed on the first side of the second half of the platform, wherein the second lip extends downwardly and generally perpendicularly from the top surface of the second half of the platform; wherein the platform is for placing in the window unit over a window sill and below a window such that the first lip and second lip extend over the window sill and into a room of the building and the second side of the first half of the platform and the second side of the second half of the platform extend outwardly from the window sill; wherein the air conditioner can be placed atop the platform;

(d) a first adjustable pivot arm for supporting the platform in the window unit; wherein the first adjustable pivot arm has an inner pole telescopically received in an outer pole; wherein the inner pole has a first end and a second end; wherein the outer pole has a first end and a second end; wherein the first end of the inner pole is pivotally attached to the bottom surface of the first half of the platform via a pivot device; wherein the length of the first adjustable pivot arm as measured from the first end of the inner pole to the second end of the outer pole is adjustable by sliding the inner pole in or out of the outer pole; wherein a locking knob disposed on the first end of the outer pole can secure the inner pole inside the outer pole to lock the length of the first adjustable pivot arm;

(e) a second adjustable pivot arm for supporting the platform in the window unit; wherein the second adjustable pivot arm has an inner pole telescopically received in an outer pole; wherein the inner pole has a first end and a second end; wherein the outer pole has a first end and a second end; wherein the first end of the inner pole is pivotally attached to the bottom surface of the second half of the platform via a pivot device; wherein the length of the second adjustable pivot arm as measured from the first end of the inner pole to the second end of the outer pole is adjustable by sliding the inner pole in or out of the outer pole; wherein a locking knob disposed on the first end of the outer pole can secure the inner pole inside the outer pole to lock the length of the second adjustable pivot arm;

(f) a first attachment pad pivotally attached to the second end of the outer pole of the first adjustable pivot arm;

(g) a second attachment pad pivotally attached to the second end of the outer pole of the second adjustable pivot arm; wherein the first attachment pad and the second attachment pad help to prevent the first adjustable pivot arm and the second adjustable pivot arm from sliding down a wall of the building below the window unit; and (h) a first adjustment bar for raising or lowering the first half, wherein the first adjustment bar is removably attached to the bottom surface of the first half of the platform near the first lip.

2. An air conditioner support device for supporting an air conditioner in a window unit in a building, said air conditioner support device comprising:

(a) a platform having a first half and a second half, wherein the first half has a top surface, a bottom surface, a first side, a second side third side, and a fourth side; wherein the second half has a top surface, a bottom surface, a first side, a second side, a third side, and a fourth side; the third side of the first half and the third side of the second half are slidably connected via a connecting rod; wherein the connecting rod allows the first half and the second half to slide closer together or farther apart;

(b) a first lip disposed on the first side of the first half of the platform, wherein the first lip extends downwardly and generally perpendicularly from the top surface of the first half of the platform;

(c) a second lip disposed on the first side of the second half of the platform, wherein the second lip extends downwardly and generally perpendicularly from the top surface of the second half of the platform; wherein the platform is for placing in the window unit over a window sill and below a window such that the first lip and second extend over the window sill and into a room of the building and the second side of the first half of the platform and the second side of the second half of the platform extend outwardly from the window sill; wherein the air conditioner can be placed atop the platform;

(d) a first adjustable pivot arm for supporting the platform in the window unit; wherein the first adjustable pivot arm has an inner pole telescopically received in an outer pole; wherein the pole has a first end and a second end; wherein the outer pole has a first end and a second end; wherein the first end of the inner pole is pivotally attached to the bottom surface of the first half of the platform via a pivot device; wherein the length of the first adjustable pivot arm as measured from the first end of the inner pole to the second end of the outer pole is adjustable by sliding the inner pole in or out of the outer pole; wherein a locking knob disposed on the first end of the outer pole can secure the inner pole inside the outer pole to lock the length of the first adjustable pivot arm;

(e) a second adjustable pivot arm for supporting the platform in the window unit; wherein the second adjustable pivot arm has an inner pole telescopically received in an outer pole; wherein the inner pole has a first end and a second end; wherein the outer pole has a first end and a second end; wherein the first end of the inner pole is pivotally attached to the bottom surface of the second half of the platform via a pivot device; wherein the length of the second adjustable pivot arm as measured from the first end of the inner pole to the second end of the outer pole is adjustable by sliding the inner pole in or out of the outer pole; wherein a locking knob disposed on the first end of the outer pole can secure the inner pole inside the outer pole to lock the length of the second adjustable pivot arm;

(f) a first attachment pad pivotally attached to the second end of the outer pole of the first adjustable pivot arm;

(g) a second attachment pad pivotally attached to the second end of the outer pole of the second adjustable pivot arm; wherein the first attachment pad and the second attachment pad help to prevent the first adjustable pivot arm and the second adjustable pivot arm from sliding down a wall of the building below the window unit; and (h) a second adjustment bar for raising or lowering the second half, wherein the second adjustment bar is removably attached to the bottom surface of the second half of the platform near the first lip.

* * * * *